US005392688A

United States Patent [19]

Boutet et al.

[11] Patent Number: 5,392,688

[45] Date of Patent: Feb. 28, 1995

[54] TRIGGER FOR A FIRING WEAPON

[75] Inventors: Claude Boutet; Patrice Pichot, both of Bourges, France

[73] Assignee: GIAT Industries, France

[21] Appl. No.: 69,721

[22] Filed: Jun. 1, 1993

[30] Foreign Application Priority Data

Jun. 2, 1992 [FR] France ..... 92 06631

[51] Int. Cl.[6] ..... F41G 3/14

[52] U.S. Cl. ..... 89/41.09; 89/41.17; 89/41.06

[58] Field of Search ..... 89/41.09, 41.17, 41.18, 89/41.19, 41.06, 28.05, 28.2, 133, 135

[56] References Cited

U.S. PATENT DOCUMENTS

| | | | |
|---|---|---|---|
| 1,731,776 | 10/1929 | Henry | 89/41.17 |
| 2,555,311 | 6/1951 | Bird | 89/135 |
| 2,750,844 | 6/1956 | Davis . | |
| 3,241,445 | 3/1966 | Zehfeld et al. | 89/28.05 |
| 3,659,494 | 5/1972 | Philbrick et al. | 89/41.17 |
| 4,166,406 | 9/1979 | Maughmer | 89/1.815 |
| 5,171,933 | 12/1992 | Eldering | 89/41.06 |

FOREIGN PATENT DOCUMENTS

| | | | |
|---|---|---|---|
| 2361624 | 3/1978 | France . | |
| 271864 | 2/1913 | Germany . | |
| 48313 | 9/1988 | Germany . | |
| 2255398 | 11/1992 | United Kingdom | 89/135 |

OTHER PUBLICATIONS

Proceedings of the IEEE 1978 National Aerospace and Electronics Conference vol. 1, May 16, 1978, Dayton Convention Center, pp. 204–219.

*Primary Examiner*—Stephen M. Johnson
*Attorney, Agent, or Firm*—Parkhurst, Wendel & Rossi

[57] ABSTRACT

A firing system integrated with a weapon for firing the weapon includes a referencing device for locating a target within a plane, a tripper for activating the referencing means, a calculator connected to the referencing means for calculating the virtual mean point of the target based on movement of the weapon, and for generating a firing signal. The firing signal is received by an ignition mechanism for firing the weapon, and generating device is provided for electrically powering the components of the firing system. According to the present invention, accuracy of the weapon user is increased, while providing increased safety.

12 Claims, 2 Drawing Sheets

TRIGGER FOR A FIRING WEAPON

BACKGROUND OF THE INVENTION

1. Field of the Invention

The present invention concerns a firearm trigger and more generally any firearm of which the aiming is done by the firing operator, i.e. the shooter.

2. Description of the Prior Art

It is well known to equip a weapon with sighting means consisting of front and rear sights; the aiming line thus defined is then aligned with a target and the shooter can start firing. The probability of a hit is considered fairly low because entangled in many factors: the weapon's accuracy, outside conditions and the sight. The two first factors are fairly benign because known conventional solutions may be resorted to in order to improve the probability of hit. However the third factor never could be taken into account because of subjectivity even though it is fairly critical. The average footsoldier or the shooter in combat does shake and therefore he cannot stably position his weapon relative to the target. Accordingly, in actual combat, the average number of fired cartridges to hit a target is fairly high. This drawback is made worse yet by aiming degradation at the moment the firing operator presses the trigger to start firing.

It has been observed that dispersions of 5 m take place for shooting at a distance of 300 m. In that case firing must be repeated, whereby the shooter is in greater danger of being located.

The inaccuracies furthermore increase with a moving target and both determining the point aimed at and the time of firing become haphazard because of the bullet travel time.

SUMMARY OF THE INVENTION

The object of the present invention is to increase the likelihood of a target hit by eliminating the human factor when initiating firing by ensuring the latter be independent of the shooter.

For that purpose the invention proposes a trigger for a firing weapon which in particular comprises a barrel, a chamber, an ammunition magazine, means moving the ammunition from the magazine in the weapon's chamber, a grip and a tripper, characterized in that it comprises a reference member allowing to locate a target in a plane, a calculator associated with electronic processing means allowing to calculate an average aiming point on the basis of the data from the calculator and controlling firing, an ignition circuit triggering the firing of ammunition located in the weapon chamber using an ignition circuit, and an electric generator powering the reference member, the calculator and the ignition circuit.

In another feature of the invention, the reference member consists of two gyro-lasers providing the target coordinates in a plane perpendicular to the barrel axis, each gyro-laser comprising a mechanical reference parallel to the barrel axis.

In yet another feature of the invention, the tripper is electrical and evinces at least three positions:

- a first position activating the gyro-lasers,
- a second position controlling firing the ammunition, and
- a third position controlling direct firing.

As a rule the ignition mechanism is either electrical high-voltage where electrically initiated ammunition is concerned, or it is of the mechanical percussion type with a power circuit and an electromagnet to drive the firing pin where percussion-initiated ammunition is concerned.

In still another feature of the invention, the calculator, the gyro-lasers and the ignition circuit are housed in the weapon's stock.

In a last feature of the invention, the electric generator is housed in the weapon grip.

One advantage of the present invention is the very substantial improvement in firing accuracy by average shooters especially in conflict situations when shaking due to stress much lowers the probability of a target-hit regardless of firing at a stationary or moving target.

Another advantage is the concurrent decrease in ammunition expenditure.

Yet another advantage is the fact that the weapon always shall remain operational even if the trigger were to fail, without any modification being required.

Accordingly, with such a trigger, when the shooter starts firing, in fact it will be the trigger of the invention that shall initiate the first shot rather than the shooter himself when the sight passes through the vicinity of the virtual theoretical average point determined by the calculator. Moreover firing is initiated only when the shooter moves near the mean point, whereby safety is increased.

Other advantages, features and details of the invention are elucidated in the following description and in relation to the attached illustrative drawings.

DETAILED DESCRIPTION OF THE PREFERRED EMBODIMENTS

Figure 1:
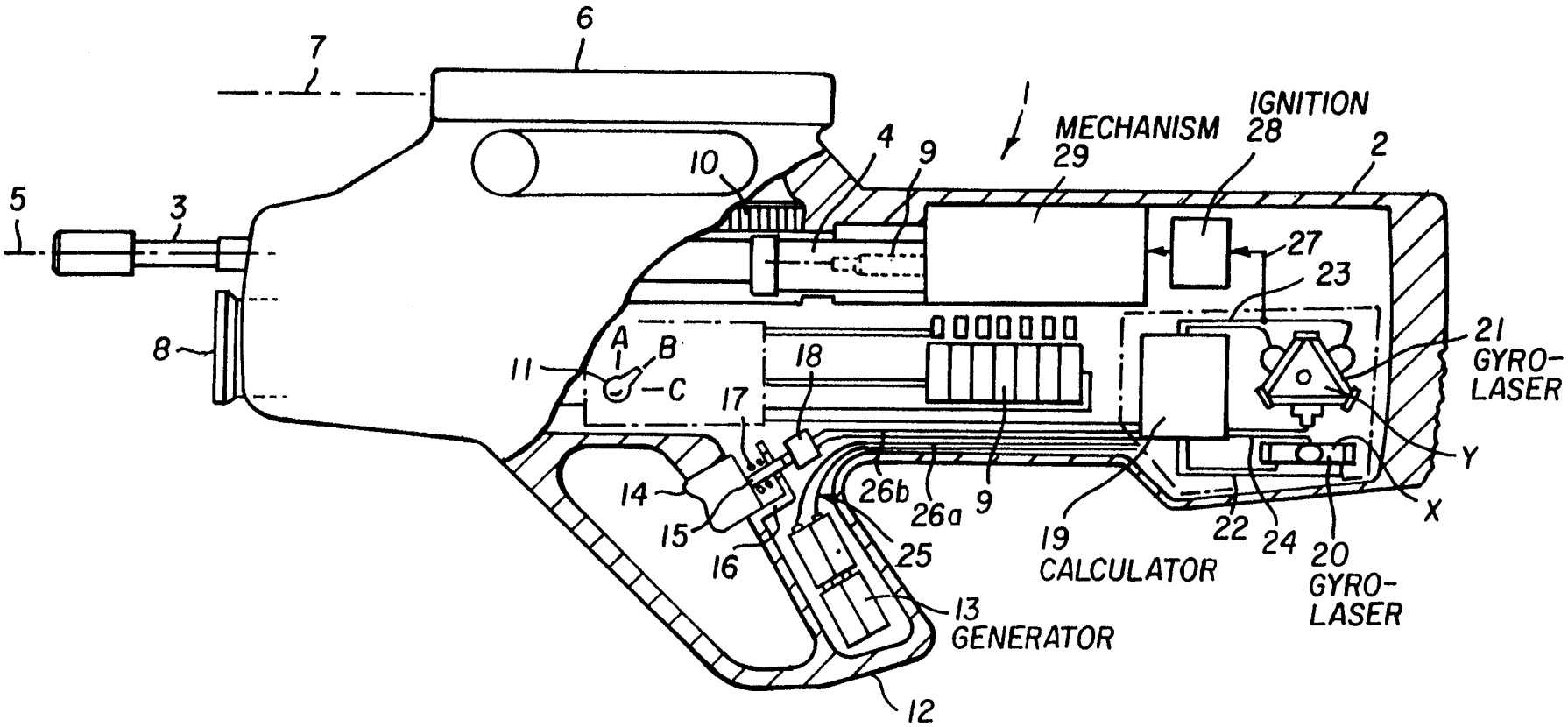
FIG. 1 is a longitudinal section with a partial cutaway of an electrically initiated weapon equipped with a trigger of the invention, FIG. 2 also is a partial longitudinal section of the stock of a mechanically ignited weapon equipped with the trigger of the invention, the other components of the weapon being identical with those of the weapon shown in FIG. 1, FIGS. 3 and 4 are aiming diagrams for stationary and moving targets, respectively, to elucidate the operation of the trigger of the invention.

A weapon denoted overall by 1 comprises in known manner a stock 2, a barrel 3 extended by a chamber 4 with an axis, called the firing axis 5. The weapon 1 also comprises a sighting support 6 defining an aiming axis 7 parallel to the firing axis 5. Furthermore this weapon comprises a magazine 8 for ammunition 9 and associated to a rearming spring 10. A control member 11 mays assume three positions A, B and C. Position A for instance may control fire bursts, position B single shots. Position C is a safety catch. The weapon 1 comprises a grip 12 into which are integrated power supplies consisting of cells or storage batteries and a tripper 14 rigidly joined to a spindle 15 sliding relative to a support 16 rigidly affixed to the grip 12.

The tripper 14 is subject to the action of a spring 17 to return said tripper into its initial position. The spindle 15 is fitted at its end with a control circuit 18 allowing to set the tripper 14 into three depth positions explained further below.

In the invention, a known type calculator 19 associated with a processing electronics, a microprocessor and a triggering circuit are mounted in the stock 2. The purpose of the calculator is to process electric signals received as a function of firing sequence discussed below and to emit a signal authorizing firing. For that purpose two gyro-lasers 20 and 21 allow defining a weapon reference point. The gyro-laser 20 defines a direction x and comprises a mechanical reference parallel to the barrel axis 5. Similarly the gyro-laser 21 defined a direction y and comprises a mechanical reference parallel to the barrel axis 5. Preferably the x and y directions are mutually orthogonal and define a plane perpendicular to the barrel firing axis 5. The gyro-laser 20 is connected by input leads 22 to the calculator 19 and the gyro-laser 21 is connected by input leads 23 to the calculator. The two gyro-lasers 20 and 21 are controlled from the calculators 19 by output leads 24. The calculator 19 and the gyro-lasers 20 and 21 are electrically fed from the generator 13 through conductors 25. The calculator 19 also is connected by conductors **26*a* to the tripper 14 and by a conductor 26*b* to the control member 11**.

The calculator 19 emits a signal transmitted through a control 27 to an ignition circuit 28. This circuit 28 is supplied with high voltage and initiates an electric igniter of the ammunition 9. The circuit 28 is an electronic sub-assembly for converting current into high voltage. The mechanism 29 is commercially available and ensures electric initiation of the ammunition 9 present in the weapon chamber 4.

Figure 2:
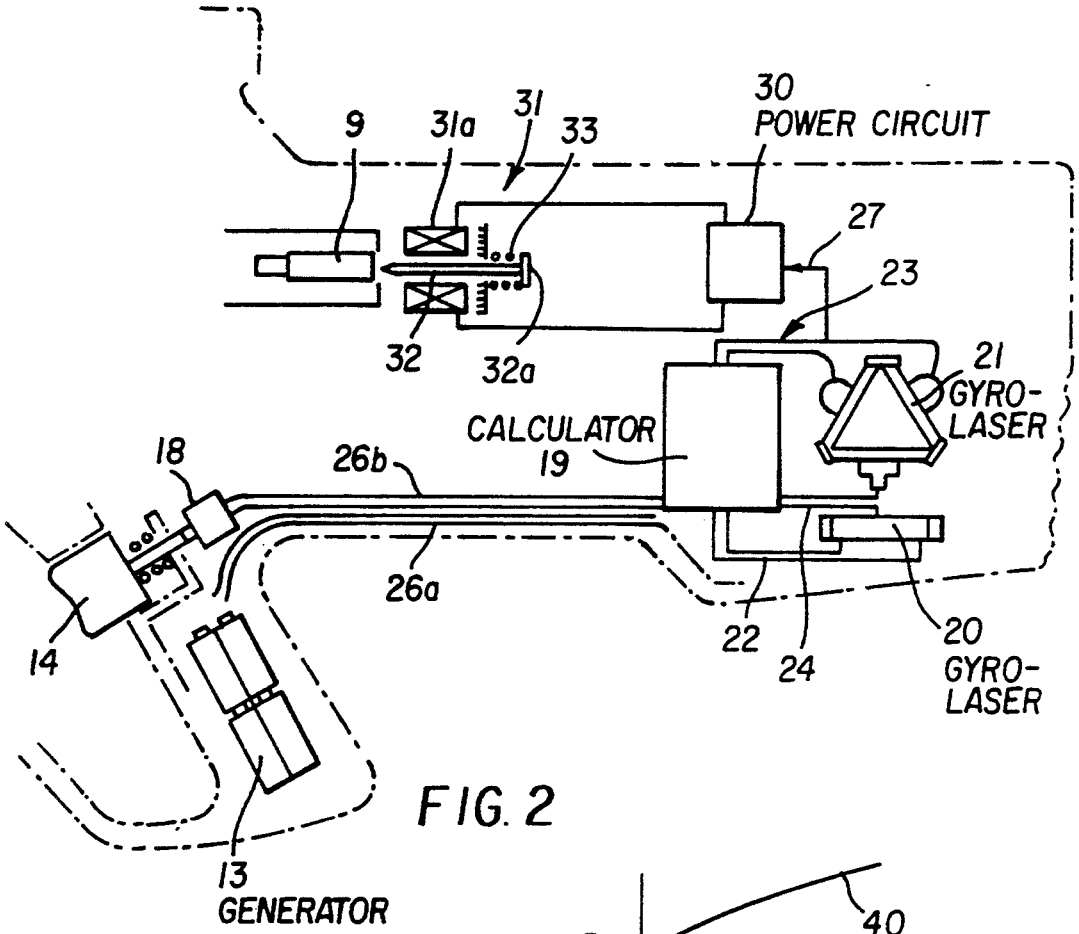

In a variation illustrated by FIG. 2, the circuit 28 and the mechanism 29 are replaced by a sub-assembly ensuring ignition by mechanically striking the ammunition 9. For that purpose the control signal 27 is fed to a power circuit 30 driving the coil **31*a* of an electro-magnet 31 in turn driving a striking pin 32 to impact the ammunition 9 present in the chamber 4**.

Illustratively the striking pin 32 is a steel or soft iron rod and it is housed inside the coil **31*a*. At its rear the striking pin 32 comprises a shoulder 32*a* against which rests a return spring 33. When the coil 31*a* is powered, the magnetic field so created inside the coil 31*a* moves the striking pin 32 which by percussion initiates the ammunition present in the chamber 4. Next the current is interrupted and the striking pin 32 is moved back by the return spring 33 into its arming position. The other weapon components are identical with those shown in FIG. 1**.

Figure 3:
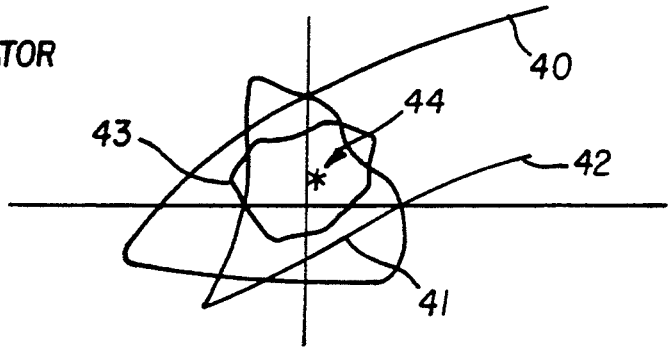

Operation is the same whether ignition is electrical or mechanical, namely as follows: As shown by FIG. 3, the shooter aims along line 40. In the absence of the trigger of the invention, he presses the tripper 14 when at point 41 whereas the actual firing position takes place at point 42. This firing mode will be the case when the shooter presses the tripper 14 all the way with the control member being in position A or position B. In the invention, the shooter proceeds as described above by following the curve 40 and by pressing the tripper which, as already stated does comprises three depth positions. The first position powers the gyro-lasers 20, 21 and the calculator 19. The second position controls firing and the third allows direct firing without the trigger of the invention.

In concrete terms, once the shooter has aimed and is on target, he presses the tripper 14 to reach the first depth position cited above. The gyro-lasers 20 and 21 provide a reference and the calculator records the equation of a curve 43 obtained by aiming at the target and processes this curve in real time to compute a virtual theoretical mean point 44 very near the actual target center. Obviously the shot shall be fired only if the shooter moves again into said zone near the mean point. Thus, by pressing the tripper 14 to pass to the second position, the shooter corrects his aim and the calculator triggers firing when the aiming line again comes near the mean point. Otherwise firing will be impossible and letting go of the tripper shuts off power to the gyro-lasers and erases the stored information.

Figure 4:
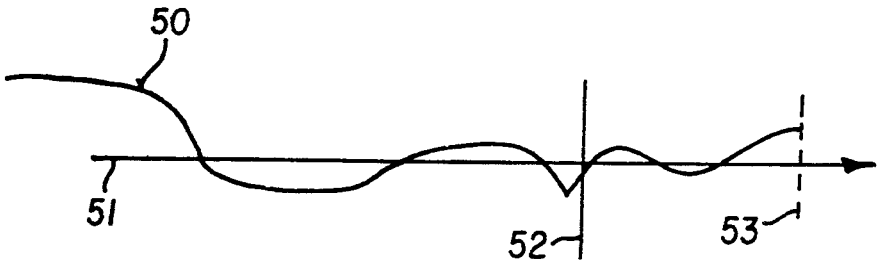

A slightly different scenario takes place when firing at a moving target. As schematically shown in FIG. 4, the shooter aims by following the target along the actual aiming curve 50 and he presses the tripper 14 into the first position. Thereupon the gyro-lasers 20 and 21 are powered and provide a reference in a plane perpendicular to the firing axis. The shooter continues following the target and the calculator determines a mean curve 51 using a fourth degree polynomial. He presses further on the tripper to arrive at the second position and he anticipates the target itinerary. When the sighting line passes through the virtual point 53 of the target position, ahead of the mean point 52, the calculator 19 triggers firing.

In order that significant accuracy be achieved, clearly both the sighting line and the shooter must be free of system bias. To improve accuracy, the weapon may be fitted with all modern sighting systems such as optical or infrared telescopes, light amplifiers etc.

We claim:

1. A firing system integrated with a weapon for firing the weapon, comprising:

referencing means for locating a target within a plane;

tripper means for activating said referencing means;

calculator means for (i) receiving information from said referencing means, (ii) calculating a mean curve due to movement of the weapon, and a virtual mean point of the target from said mean curve, and (iii) generating a firing signal;

ignition means for firing the weapon upon receiving the firing signal from said calculator means; and generating means for electrically powering said referencing, calculator and ignition means.

2. The firing system of claim 1, wherein said referencing means comprises two gyro-lasers which provide target coordinates in said plane.

3. The firing system of claim 2, wherein said gyro-lasers are positioned to generate signals along x and y directions which are perpendicular to each other to define said plane.

4. The firing system of claim 1, wherein said ignition means comprises a high-voltage electrical ignition mechanism for electrically igniting ammunition.

5. The firing system of claim 1, wherein said ignition means comprises a percussion-type mechanical ignition mechanism for percussively-igniting ammunition, including an electric power circuit, an electromagnet which is powered by said electric power circuit, a strike pin which is driven by said electromagnet to strike ammunition, and a return spring for biasing said strike pin.

6. A weapon comprising:

a barrel extending along a firing axis and being connected to a chamber;

an ammunition magazine;

feeding means for feeding ammunition from said ammunition magazine to said chamber;

referencing means for locating a target within a plane perpendicular to said firing axis;

tripper means for activating said referencing means;

calculator means for (i) receiving information from said referencing means, (ii) calculating a mean curve due to movement of the weapon, and a virtual mean point of the target from said mean curve, and (iii) generating a firing signal;

ignition means for firing the weapon upon receiving the firing signal from the calculator means; and generating means for electrically powering said referencing, calculator and ignition means.

7. A firing system for firing a weapon, comprising:

referencing means for locating a target within a plane;

electrical tripper means adapted to be movable between three positions, a first position for controlling power to said referencing means, a second position for controlling firing of the weapon, and a third position for controlling direct firing of the weapon;

calculator means for (i) receiving information from said referencing means, (ii) calculating a virtual mean point of the target; and (iii) generating a firing signal;

ignition means for firing the weapon upon receiving the firing signal from said calculator means; and generating means for electrically powering said referencing, calculator and ignition means.

8. The firing system of claim 7, wherein said referencing means comprises two gyro-lasers which provide target coordinates in said plane.

9. A firing system for firing a weapon having a stock, comprising:

referencing means for locating a target within a plane;

tripper means for activating said referencing means;

calculator means for (i) receiving information from said referencing means, (ii) calculating a virtual mean point of the target, and (iii) generating a firing signal;

ignition means for firing the weapon upon receiving the firing signal from said calculator means; and generating means for electrically powering said referencing, calculator and ignition means, wherein said referencing, calculator and ignition means are housed within the stock of the weapon.

10. The firing system of claim 9, wherein said referencing means comprises two gyro-lasers which provide target coordinates in said plane.

11. A firing system for firing a weapon having a grip, comprising:

referencing means for locating a target within a plane;

tripper means for activating said referencing means;

calculator means for (i) receiving information from said referencing means, (ii) calculating a virtual mean point of the target, and (iii) generating a firing signal;

ignition means for firing the weapon upon receiving the firing signal from said calculator means; and generating means for electrically powering said referencing, calculator and ignition means, wherein said generating means is housed within the grip of the weapon.

12. The firing system of claim 11, wherein said referencing means comprises two gyro-lasers which provide target coordinates in said plane.

* * * * *